United States Patent [19]

Meyer

[11] Patent Number: 4,734,148

[45] Date of Patent: Mar. 29, 1988

[54] PROCESS FOR MAKING A DETACHABLE PLASTIC BAG PAD

[75] Inventor: Armin Meyer, Cologne, Fed. Rep. of Germany

[73] Assignee: Elmo M. Lehmacher & Sohn GmbH Maschinenfabrik, Niederkassel-Mondorf, Fed. Rep. of Germany

[21] Appl. No.: 882,272

[22] Filed: Jul. 7, 1986

Related U.S. Application Data

[62] Division of Ser. No. 749,872, Jun. 27, 1985, Pat. No. 4,690,280.

[30] Foreign Application Priority Data

Jul. 5, 1984 [DE] Fed. Rep. of Germany ..... 3424748

[51] Int. Cl.[4] ..... B65D 30/00; B65D 33/02; B65D 33/08

[52] U.S. Cl. ..... 156/251; 156/253; 156/254; 156/259; 156/510; 156/513; 156/563; 206/493; 206/554; 206/806; 383/9; 383/10; 383/20; 383/37; 493/204; 493/227; 493/233

[58] Field of Search ..... 156/557, 558, 563, 258, 156/254, 253, 252, 259; 493/204, 227, 233; 383/9, 10, 20, 37; 206/493, 554, 806

[56] References Cited

U.S. PATENT DOCUMENTS

| | | | |
|---|---|---|---|
| 1,254,966 | 1/1918 | Bens | 206/554 |
| 2,973,797 | 3/1961 | Sylvester | 156/563 |
| 3,000,549 | 9/1961 | Stange et al. | 206/554 |
| 3,385,428 | 5/1968 | Kugler | 206/554 |
| 3,417,864 | 12/1968 | Paxton | 206/493 |
| 3,548,723 | 12/1970 | Sengewald | 156/253 |
| 3,646,723 | 3/1972 | Meroney | 53/390 |
| 4,046,257 | 9/1977 | Lehmacher | 206/554 |
| 4,291,807 | 9/1981 | Giordano et al. | 206/626 |
| 4,360,106 | 11/1982 | Irvine et al. | 206/621 |
| 4,500,000 | 2/1985 | Membrino | 206/554 |
| 4,557,384 | 12/1985 | Membrino | 206/554 |

FOREIGN PATENT DOCUMENTS

| | | |
|---|---|---|
| 2228767 | 12/1972 | Fed. Rep. of Germany . |
| 2204638 | 7/1974 | Fed. Rep. of Germany . |
| 2526014 | 12/1976 | Fed. Rep. of Germany . |
| 3222376 | 12/1983 | Fed. Rep. of Germany . |
| 2291106 | 10/1972 | France . |
| 2314871 | 6/1975 | France . |

*Primary Examiner*—Donald E. Czaja
*Assistant Examiner*—Lori Cuervo
*Attorney, Agent, or Firm*—Karl F. Ross; Herbert Dubno

[57] ABSTRACT

A stack of interlocked detachable bags, preferably formed from a thermoplastic foil strip, and each comprising two walls, a front wall and a back wall, preferably at least one handle-shaped incision positioned on one of said walls adjacent an upper filling opening, wherein the individual bags each have an interlock piece and are attached together with the aid of at least one interlock means engaging their interlock pieces, and by means of a row of perforations forming an edge of the interlock piece the individual bags are detachable from the interlocked stack by tearing off. On one of the walls of each bag adjacent an upper filling opening edge of that bag a reinforcing piece, preferably of plastic foil, with the interlock piece is attached so that the interlock piece protrudes above the filling opening edge. Advantageously the inside of the back wall is provided with the protruding interlock and reinforcing pieces. The interlock means is put into the interlock pieces of the stacked individual bags to form the stack of interlocked detachable bags. A process for making the stack of interlocked detachable bags is also described.

5 Claims, 7 Drawing Figures

PROCESS FOR MAKING A DETACHABLE PLASTIC BAG PAD

This is a continuation of co-pending application Ser. No. 749,872 filed on June 27, 1985, now U.S. Pat. No. 4,690,280.

FIELD OF THE INVENTION

My present invention relates to detachable plastic bag pads and, more particularly, to stacks of interlocked bags made of thermoplastic foil from which individual bags are detachable, for example by tearing along a row of perforations. The invention also relates to a process for making a stack or pad of detachable interlocked bags.

BACKGROUND OF THE INVENTION

A pad or stack of plastic, usually thermoplastic bags generally comprises a multiplicity of individual bags positioned so as to be congruent and attached to each other and joined together e.g. by fusion.

Each of the bags has a front wall, a back wall, an upper bag opening, and handle-shaped punch-outs or incisions in the walls adjacent the edges of the upper bag opening.

The individual bags of the interlocked stack can be detachable from the stack or pad by a row of perforations.

These kinds of bags also may advantageously be provided with hanging means so that they can be mounted on a storage rack, display stand, or the like; the means cooperating with such a support can be, for example, punch-outs or hang-up holes.

The pad of thermoplastic bags described in German Patent document DE-AS No. 22 04 638 uses film material; these bags appear shirtlike and are so called.

An interlock weld connection runs along an upper edge of an interlock piece from which the shirtlike bags are torn away, and which have correspondingly handle-shaped punch-outs and a tear-away perforation.

A similar structure is taught in German Patent document DE-AS No. 21 41 045 where the filing opening is formed only by tearing away the bag. These interlocked detachable bags cannot be filled while they remain attached to the pad and must be first torn-away from their stack.

Individual carrying bags of thermoplastic foil strip, are described in German Patent document DE-DS No. 25 26 014, wherein the front wall and back wall have handle-shaped punch-outs and the upper edges of these walls form a filling opening. On at least one of these walls at the filling opening edge adjacent its handle-shaped punch-out a reinforcing piece of plastic foil is cemented.

Furthermore, the bags in prior art stacks or interlocked detachable bags are not simply interlocked in many cases, so that the bags cannot easily be manipulated, filled or torn away.

German Patent document DE-OS No. 22 28 767 provides a mechanical interlocking device. The individual bags are threaded on this interlocking device. This device is so formed that the front wall of the attached bag is easily freed therefrom, so that the filling can easily take place, while the bag remains attached in the stack by its back wall.

OBJECTS OF THE INVENTION

It is the principal object of the invention to provide a stack or pad of interlocked detachable bags having a reinforcing piece attached to at least one of the walls and formed with a handle-shaped punch-out adjacent the bag opening, but where individual bags are easily manipulated in the interlocked state and are also easily filled in that state.

It is a more specific object of my invention to provide an improved pad of detachable bags, particularly of bags made of plastic foil.

It is also an object of my invention to provide an improved stack of interlocked detachable bags, which are easily filled and manipulated in the interlocked state, but do not require any additional interlocking devices such as pins, clips or the like to form the stack.

It is yet another object of my invention to provide an improved process for making the above-mentioned improved stack of interlocked detachable bags.

SUMMARY OF THE INVENTION

These objects and others which will become more readily apparent hereinafter are attained in accordance with the invention which provides that the individual bags of the pad, constituted of thermoplastic synthetic resin, hereinafter referred to as plastic, have front and rear walls which define a bag opening at an upper side of the bag and have respective upper edges along this opening. At least the rear wall is formed with a reinforcement along its said edge in the form of an additional layer of material, preferably extending only over a fraction of the length of this edge, while both walls or panels are formed with punch-outs (e.g. incisions) defining handle openings proximal to the respective said edges, the incision in the rear wall being formed in the reinforcement. According to an important feature of the invention the reinforcement is extended above the said edge of the rear wall and the bag is bonded to other bags in a stack to form the pad at the extensions, the bonding preferably being effected by spot welding or point heat sealing. Preferably both walls of each bag have respective reinforcements bonded thereto, the front-wall reinforcement terminating below the point heat seals and most advantageously at the respective said edge. Thus the stack of interlocked detachable bags comprises a multiplicity of individually-carryable bags, preferably of a thermoplastic foil, each having two walls, a front wall and a back wall, and preferably at least one handle-shaped punch-out associated with one of the walls adjacent an upper filling opening, wherein the individual bags are attached together with the aid of at least one interlock means in an interlock piece connected to each individual bag.

Processes for making stacks of interlocked detachable bags of the above-described kind include unfolding at least one upper strip edge of a double-layered plastic foil strip moving lengthwise, that is, in the direction of its own length, attaching a reinforcing piece on the exposed inner side of the plastic foil strip adjacent the edges of the foil strip, punching the handle-shaped incisions, and performing the transverse bag forming cutting and welding operations.

Furthermore in preferred embodiments of this process two individually-carryable bags are formed side-by-side in a process comprising cutting the upper layer of a double-layered plastic foil strip lengthwise centrally, unfolding each of the opposing upper strip edges simultaneously, applying and cementing on the doubled reinforcing pieces or the two individual reinforcing pieces to the exposed opposing inner sides of the plastic foil strip, cutting the lower layer of the double layered plastic foil strip lengthwise centrally, punching handle-shaped incisions, and effecting the transverse bag forming cutting and welding operations.

According to my invention on one of the bag walls, which forms an upper filling opening edge, a reinforcing piece, preferably of plastic foil, is attached with an interlock piece adjacent the handle-shaped punch-outs, so that the interlock piece protrudes above the filling opening edge, the interlock piece having a row of perforations, at which the associated bag is detached by tearing it away.

When the individual bags, which in the front wall as well as the back wall have handle-shaped punch-outs, and are provided with reinforcing pieces in accordance with the invention, a detachable stack can be formed in an easy way, when the interlock weld joint is put in the protruding part of the reinforcing piece, which functions thereby as the interlock piece.

My invention utilizes the fact that the individual bags in the stack are individually easily manipulated and filled, when the back wall of the individual bags is provided with the reinforcing piece equipped with the interlock piece, which has the interlock weld joint. Of particular advantage is that the stack of detachable interlocked bags according to my invention can be easily manufactured.

In my invention the wall with the projecting interlock piece is the back wall and the interlock weld joint is positioned in the interlock piece of the individual bag. Usually both walls are equipped with a reinforcing piece, only one of which is required by the interlock piece.

In particular different possibilities for further embodiments exist in which the individual bags are connected in different configurations. For example the protruding reinforcing piece with the interlock piece may be applied to and pasted on the inside of the back wall of the individual bags. Furthermore advantageously the interlock means may be of a heated spike weld joint, that is, the spot weld or point seal by a heated spike.

Particularly in embodiments in which the individually carryable bags have a straight filling opening edge, advantageously the row of perforations of the protruding pieces coincides with the filling opening edges.

In embodiments which have a sinusoidal filling opening edge, which bounds a sinusoidal central region having the handle-shaped punch-outs therein, the row of perforations of the reinforcing pieces run secantlike under the upper part of the filling opening edges, and the portion of the wall associated with the interlock piece protruding above the perforations contacts freely the reinforcing piece without being attached.

The process for making the above-described bags according to my invention includes established prior art steps of the type described in German Pat. DE-PS No. 25 26 014 and DE-OS No. 32 22 376.

According to the process of my invention the reinforcing piece is applied to one of the walls, and advantageously attached with the interlock piece projecting, and after stacking of the finished bags, the interlock weld joint is put into the interlock pieces of the bags so as to form an interlocked stack. The interlock joint is advantageously formed by applying a heated spike through the interlock pieces of the stacked, finished bags.

BRIEF DESCRIPTION OF THE DRAWING

The above and other objects, features and advantages of my invention will become more readily apparent from the following detailed description, reference being made to the accompanying highly diagrammatic drawing in which.

SPECIFIC DESCRIPTION

Figure 1:
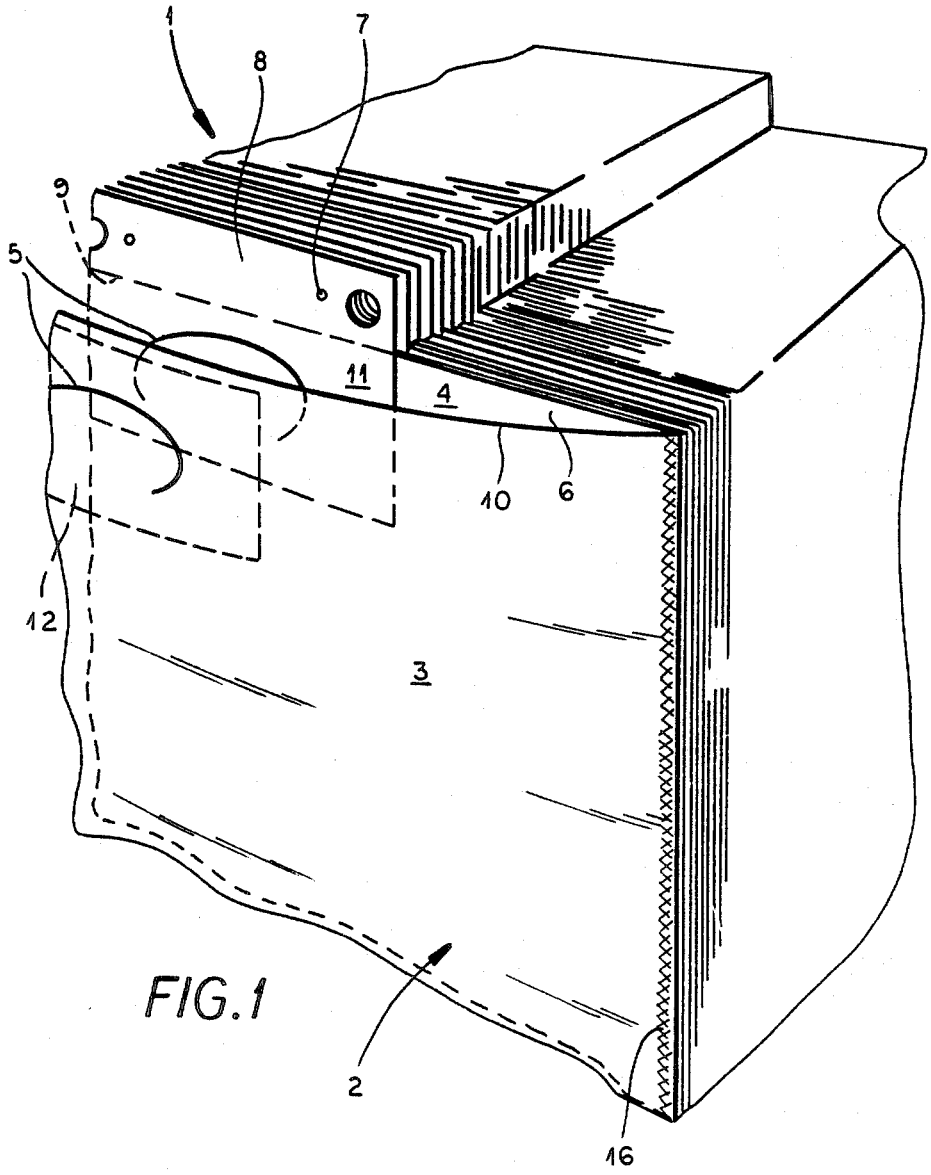
FIG. 1 is a perspective, cutaway view of a preferred embodiment of a stack of interlocked detachable bags according to my invention drawn larger than their natural size.

The stack 1, as illustrated in the drawing, comprises a plurality of interlocked detachable bags 2 of thermoplastic foil. The individual bags 2 have a front wall 3, a back wall 4, and on each wall 3 or 4 a handle-shaped punch-out or incision 5 adjacent an upper bag opening 6.

These punch-outs 5 are found to be congruent in front wall 3 and back wall 4. The individually carryable bags 2 are bound together and interlocked with the aid of at least one interlock weld joint 7, which is found in an interlocking piece 8. The interlocked detachable bags 2 can be manually torn away from the stack 1 because of a row of perforations 9 connecting the interlock piece 8 to the rest of the bag. The front wall 3 and the back wall 4 have over their entire width a filling opening edge 10.

Reinforcing pieces 11 and 12 of plastic foil are cemented on both walls 4 and 3. The reinforcing piece 11 from only one wall 4 of the walls 3 and 4 protrudes above the filling opening edge 10 with the interlock piece 8 being integral therewith at the row of perforations 9.

This interlock piece 8 is left behind when the individual bag 2 is torn away from the stack 1 since the bag 2 is separated from the stack 1 at the row of perforations 9.

In the stack 2 the wall with the projecting interlock piece 8 forms the back wall 4.

In order to make clear that only the back wall 4 has a protruding reinforcing piece 11, a number of these walls in FIG. 1 are indicated by lines near the interlocking piece 8 only half the size of the neighboring lines, which permit the filling opening edge 10 of the front wall 3 and the back wall 4 to be shown, even when no rear view appears in the drawing. The detachable bags 2 in the interlocked stack 1 are actually pressed tightly one on another and the plastic foil is extremely thin so that the fine distinction clear from FIGS. 1 and 4 may not be visible in practice.

Preferably the protruding reinforcing piece 11 is cemented on the inner side of the associated back wall 4.

Figure 2:
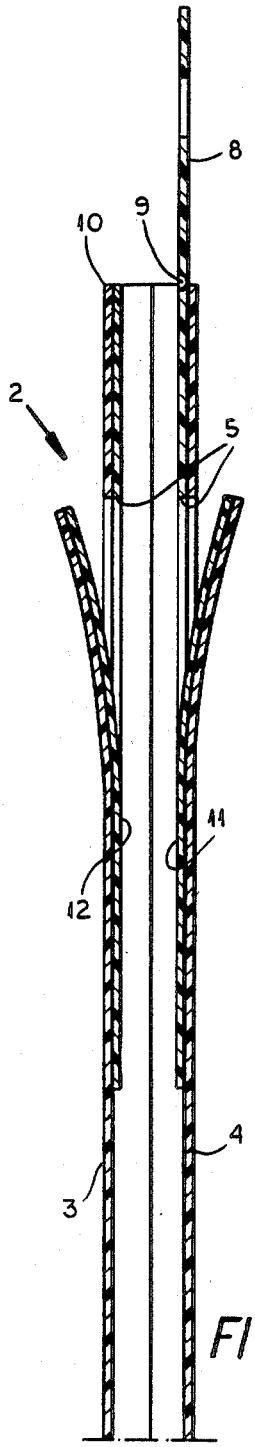
FIG. 2 is a similarly enlarged cross sectional view of an individual detachable bag from the interlocked stack of bags of FIG. 1.

The embodiment shown in FIGS. 1 and 2 has individually carryable bags 2 which have straight filling opening edges 10. From a comparison of FIGS. 1 and 2 it can be seen that the protruding reinforcing piece 11 has a row of perforations 9 where the interlock piece 8 is attached, which coincides with the straight filling opening edge 10.

Figure 3:
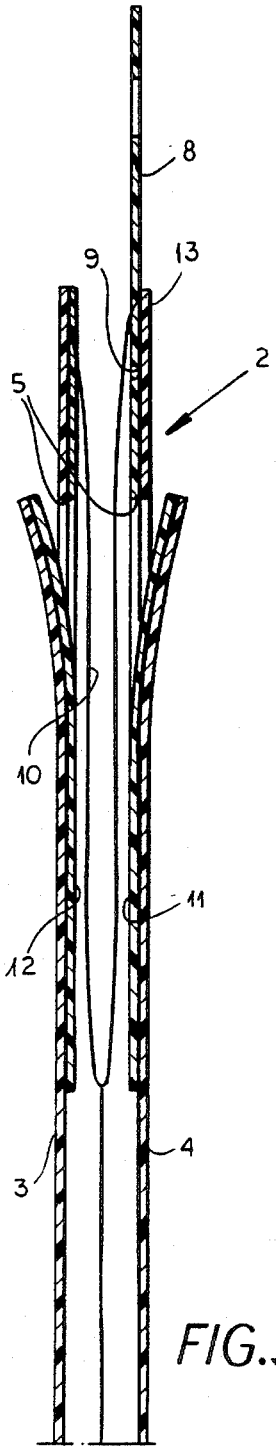
FIG. 3 is similar to FIG. 2 a cross sectional view of another embodiment of an individual detachable bag from an interlocked stack of bags according to my invention.
Figure 4:
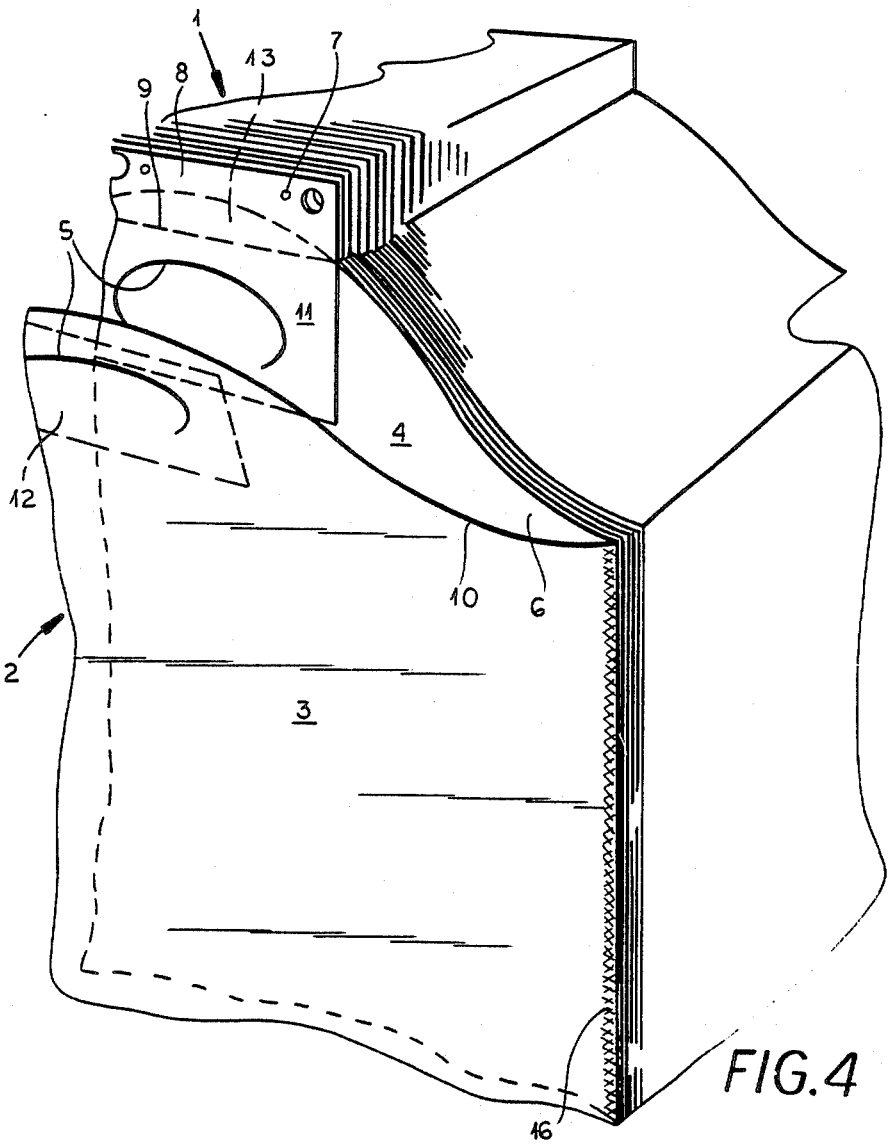
FIG. 4 is a perspective cutaway view of a stack of interlocked detachable bags according to the embodiment of FIG. 3 corresponding to FIG. 1.

Otherwise the proportions in this embodiment are the same as the embodiment shown in FIGS. 3 and 4. But in the embodiment of FIGS. 3 and 4 the individually carryable bags 2 have a sinusoidal form at their filling opening edges 10, which bounds a middle sinusoidal portion with handle-shaped incisions 5. Here the protruding reinforcing piece 11 has a row of perforations 9, which run secantlike below the upper portion 13 of the associated back wall 4 below the filling opening edge 10 and that portion 13 of the associated wall 4 protruding above the row of perforations 9 contacts the reinforcing piece 11 without being attached thereto, i.e. the adhesive which bonds the reinforcing piece to the panel is restricted to a region below the row of perforation.

The interlock weld joint 7 is constructed as a heated spike or spot weld or heat-seal joint.

Figure 5:
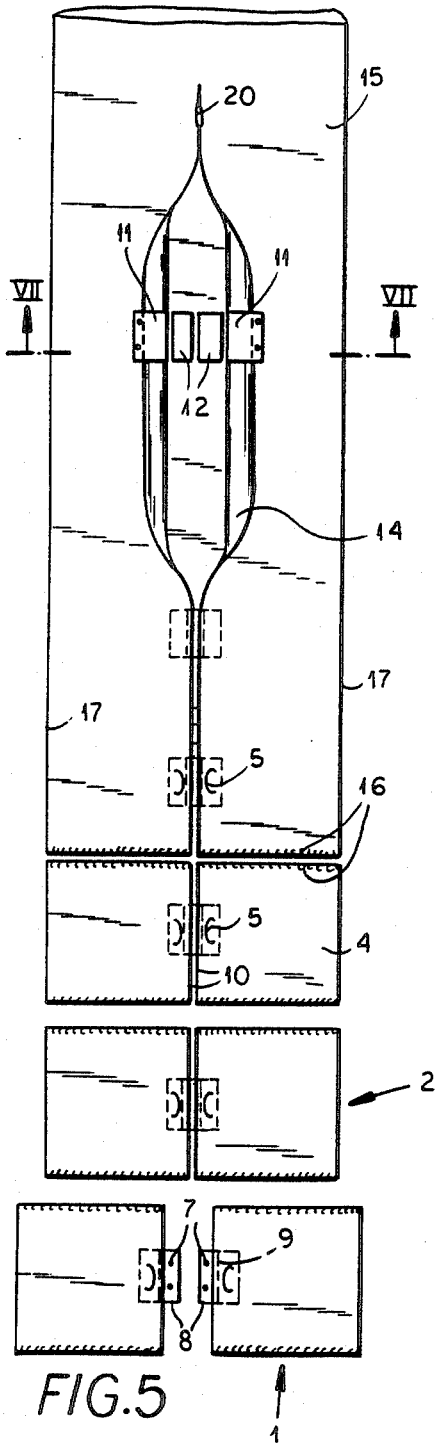
FIG. 5 is a schematic representation of a process for making a stack of interlocked detachable bags according to my invention.
Figure 6:
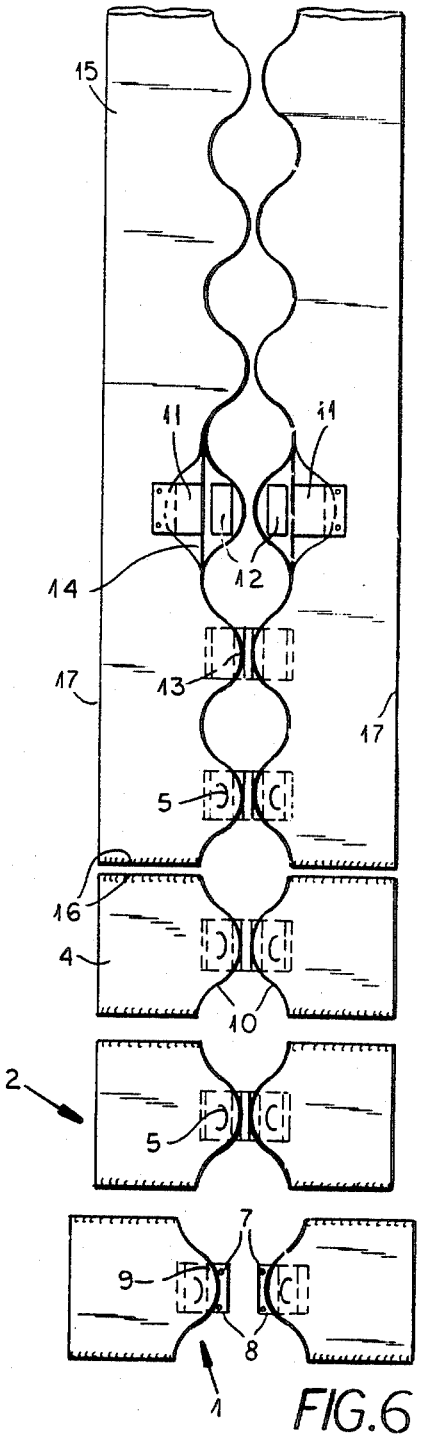
FIG. 6 is a schematic representation of a second embodiment of the process for making stacks of detachable bags.

FIGS. 5 and 6 illustrate schematically the steps which form a particularly simple process for manufacture of the above described stack 1 of interlocked detachable bags 2.

Figure 7:
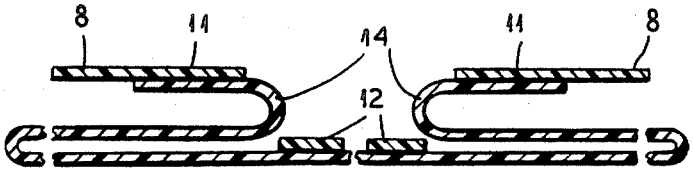
FIG. 7 is a section along line VII—VII of FIG. 5 with parts drawn to larger scale.

FIGS. 5 and 7 show that an upper strip edge 14 of a double-layered plastic foil strip 15 cyclically or continuously moved in its lengthwise direction, formed by cutting at 20, is unfolded, so that on each exposed inner side of the walls 3 and 4 reinforcing pieces 11 and 12 are cemented on, whereby immediately after folding back of the upper edge strip edge 14 the handle shaped incisions 5 are put in and after that the bag-forming transverse cuts and welds 16 are performed. FIG. 5 shows an embodiment of one such process in which simultaneously two individual bags 2 are formed side-by-side, wherein first only the upper layer of the double-layered plastic foil strip 15 is cut along its center and each upper strip edge 14 simultaneously is unfolded and next after application of the reinforcing pieces 11 and 12 the lower layer of the plastic foil strip 15 is cut along its center lengthwise. It is understood that the stack 1 of interlocked detachable bags 2 are interlocked and bound together with the aid of an interlock weld joint 7.

FIG. 5 shows that the protruding reinforcing piece 11 is applied to the folded strip edge 14, and of course with the projecting interlock piece 8 and subsequently the interlock weld joint 7 can be applied to the interlock pieces 8 after stacking the bags 2. FIG. 6 makes clear that this also can correspondingly be done when it is a case of individually carryable bags 2 having a sinusoidal shaped filling opening edge 10.

Although it could have been shown in FIGS. 5 and 6 that the protruding reinforcing pieces 11 be brought to the unfolded strip edge 14, one can easily nonetheless reverse the process, and here namely the uncut plastic foil 15 is provided with twin reinforcing pieces 12. After the lengthwise cutting of the lower and upper layer of the plastic foil strip 15 results. Subsequently after the unfolding of the strip edge 14 in the middle region a suitably enlarged reinforcing piece is cemented in place, which can later be divided into two reinforcing pieces 11 with their associated interlock pieces 8. In order that the corresponding projection of the interlock piece 8 occurs properly for its function, it is necessary in this case to adjust the lengthwise seamed edge fold 17 so that the interlock piece 8 is properly positioned. Then the handle incisions 5 and the separating cuts 16 in the vicinity of the reinforcing pieces 11 and 12 are formed.

I claim:

1. In a process for making of a stack of interlocked detachable bags comprising two walls, a front wall and a back wall, having at least one handle shaped punch out associated with one of said walls adjacent an upper filling opening, wherein said bags are attached together by at least one interlock weld joint in an interlock piece attached to one of said walls, said process comprising unfolding at least one upper strip edge of a double-layered plastic foil strip moving lengthwise, attaching a reinforcing piece on the exposed inner side adjacent said upper strip edge of said double-layered plastic foil strip, putting in said handle-shaped incisions, performing transverse bag-forming cutting and welding operations, applying said reinforcing piece to said one of said walls with said interlock piece projecting, stacking said bags, and thereafter placing said interlock weld joint into each of said interlock pieces of said bags.

2. In a process for making of a stack of interlocking detachable bags formed from a double-layered plastic foil strip comprising two walls, a front wall and a back wall, at least one handle-shaped incision associated with one of said walls adjacent an upper filling opening, wherein said bags are attached together by at least one interlock piece attached to one of said walls, said process in which two bags are formed side-by-side comprising cutting the upper layer of said plastic foil strip centrally lengthwise, unfolding both of the adjacent upper strip edges of said upper layer, applying reinforcing pieces to the exposed inner sides of said upper layer of said plastic foil strip, cutting the lower layer of said plastic foil strip lengthwise centrally, putting therein handle-shaped incisions, and performing transverse bag-forming cutting and welding operations, applying one of said reinforcing pieces to one of said walls with said interlock piece projecting, stacking said bags, and thereafter placing said interlock weld joint into each of said interlock pieces of said detachable bags.

3. In a process according to claim 2 wherein said interlock weld joint is formed by inserting a heated spike through said interlock pieces of said bags.

4. In a process according to claim 1 wherein said projecting interlock piece has a width substantially smaller than a width of any wall in said detachable bag.

5. In a process according to claim 2 wherein said projecting interlock piece has a width substantially smaller than a width of any wall in said detachable bag.

* * * * *

UNITED STATES PATENT AND TRADEMARK OFFICE

CERTIFICATE OF CORRECTION

PATENT NO. : 4,734,148

DATED : 29 March 1988

INVENTOR(S) : Armin MEYER

It is certified that error appears in the above-identified patent and that said Letters Patent is hereby corrected as shown below: On the title page The name of the Assignee should read:

--[Item 73] LEMO M. LEHMACHER & SOHN GmbH

MASCHINENFABRIK, ---

Signed and Sealed this

Twenty-seventh Day of September, 1988

*Attest:*

DONALD J. QUIGG

*Attesting Officer*

*Commissioner of Patents and Trademarks*